US007397195B2

(12) United States Patent
Yu et al.

(10) Patent No.: US 7,397,195 B2
(45) Date of Patent: Jul. 8, 2008

(54) APPARATUS OF LIGHT SOURCE AND ADJUSTABLE CONTROL CIRCUIT FOR LEDS

(75) Inventors: Chung-Che Yu, Taipei (TW); Li-Min Lee, Taipei (TW)

(73) Assignee: Beyond Innovation Technology Co., Ltd., Taipei (TW)

( * ) Notice: Subject to any disclaimer, the term of this patent is extended or adjusted under 35 U.S.C. 154(b) by 0 days.

(21) Appl. No.: 11/164,316

(22) Filed: Nov. 17, 2005

(65) Prior Publication Data

US 2007/0029946 A1 Feb. 8, 2007

(30) Foreign Application Priority Data

Aug. 3, 2005 (TW) ..... 94126315 A

(51) Int. Cl.
*G05F 1/00* (2006.01)

(52) U.S. Cl. ..... 315/194; 315/291

(58) Field of Classification Search ..... 315/194, 315/323, 322, 316, 312, 185 S, 200 A, 200 R, 315/291, 360, 246, 247, 209 R
See application file for complete search history.

(56) References Cited

U.S. PATENT DOCUMENTS 5,719,474 A * 2/1998 Vitello ..... 315/307
6,501,234 B2 12/2002 Lin et al. ..... 315/307
6,707,264 B2 3/2004 Lin et al. ..... 315/307
6,858,993 B2 * 2/2005 Lee et al. ..... 315/185 S
6,867,757 B1 * 3/2005 Nakamura ..... 345/83
2004/0001040 A1 * 1/2004 Kardach et al. ..... 345/102
2004/0032217 A1 * 2/2004 Abe et al. ..... 315/169.3

* cited by examiner

*Primary Examiner*—Trinh Vo Dinh
*Assistant Examiner*—Dieu Hien T Duong
(74) *Attorney, Agent, or Firm*—Jianq Chyun IP Office

(57) ABSTRACT

A control circuit for LEDs is adapted for controlling brightness of a plurality of LEDs as light source in an LCD. The control circuit comprises a control pulse generator and a plurality of LED direct current supplies. The control pulse generator is used for receiving a brightness adjusting signal and generating a plurality of brightness control pulse signals having the same frequency but different phases according to the brightness control signals. The work cycle of the brightness control pulse signal varies in a predetermined range according to the brightness control signal. The LED direct current provider is coupled to the control pulse generator to drive the corresponding LED according to the brightness pulse signal.

11 Claims, 5 Drawing Sheets

APPARATUS OF LIGHT SOURCE AND ADJUSTABLE CONTROL CIRCUIT FOR LEDS

CROSS-REFERENCE TO RELATED APPLICATION

This application claims the priority benefit of Taiwan application serial no. 94126315, filed on Aug. 3, 2005. All disclosure of the Taiwan application is incorporated herein by reference.

BACKGROUND OF THE INVENTION

1. Field of Invention

The present invention relates to a light adjustable control circuit, which is directed to a beam density adjustment control circuit using a plurality of LEDs as the light source. More specifically, the present invention relates to a beam density adjustment control circuit using a plurality of LEDs with different colors as the light source.

2. Description of Related Art

Using an LED as the light source, simply utilizing direct current (DC) driving circuit can realize the demand for the LCD backlight or general lighting system. Due to the characteristics, The relationship between the LCD brightness and the driving DC is non-linear, and the LCD color may also vary with the change of driving current. Thus, using LED as the light source for the LCD backlight or general lighting system becomes problematic in the application of light adjustment through adjusting the LED driving DC directly.

To overcome the shortcoming of adjusting light through the current, instead of changing the amplitude of the LED driving current, the practice at present is to adjust the light by using a predetermined working frequency to alter the LED current beam density in the case that the amplitude of the LED current is fixed, so that the LED shows the needed stable color within the maximum light adjusting range.

With reference to FIG. 1 and FIG. 2, FIG. 1 is a schematic diagram of the conventional method of using DC current supply to drive the LED and using the beam density light adjustment to control the output current. FIG. 2 is a schematic diagram of the relation between the brightness control pulse signal and the LED driving DC current signal of the circuit in FIG. 1. In FIG. 1, the brightness control pulse signal CNTL which controls the brightness/dimness of the LED 120 is input to the LED DC current supply 110 to control the LED DC current supply 110 to output an LED driving current signal Id which drives the LED 120. The LED driving current signal Id is a fixed current which sets the current value according to the brightness requirement. In FIGS. 2, (*a*), (*b*), (*c*) are three output timing diagrams of the LED driving current signal Id controlled by different pulse width outputs. FIG. 2(*a*) is a situation when the brightness is only 20% of its full brightness, FIG. 2(*b*) is an example when the brightness is only 60% of its full brightness and FIG. 2(*c*) is an example when the brightness is its 100% full brightness.

To avoid the visual interference to human eyes because of the intermittent lighting and dimming, generally the frequency of the brightness control pulse signal CNTL should not be too low; normally it is above 200 Hz. According to the effect of persistence of vision, the brightness control pulse signal CNTL with the frequency high enough can make human eyes only feel the brightness alternation of LED without flickering.

Since the frequency and the working cycle of the brightness control pulse signal CNTL used in the above description are set based on the required brightness, therefore once the brightness is adjusted, using the frequency of the brightness control pulse signal CNTL in LCD backlight may encounter the beat interference problem generated by the vertical and horizontal scanning signals in the video display signal. Because the backlight and the video signals have different frequencies that causes the so-called "fan effect", so that results in water ripples on the video images. In addition, the activation and cut-off of the LED DC current supply may also cause the loading on the power supply supplying the needed power for the LED DC current supply, so that generate the ripples with the same frequency with the brightness control pulse signal CNTL in the power supply. These ripples may also affect the video display signal and result in flickering images. In the circumstance of using more LEDs as the light source, the interference caused by the adjustment of the beam density may become severer as the LED operation power increases.

To avoid the interference caused by the different frequencies of the brightness control pulse signal CNTL and the vertical and horizontal scanning signal in the video display signal, there is a method which let the frequency of the brightness control pulse signal CNTL and the horizontal scanning signal be multiplied and synchronously. In addition, the frequency of the brightness control pulse signal CNTL can also be increased to reduce the interference to the power supply caused by formation of the ripples. However, in the trend that the LCD size is getting bigger and bigger, more and more LEDs are used, and the power consumption is getting larger and Larger, and in the circumstance of the requirement for reducing visual noise is getting stricter, it becomes more and more difficult to keep low noise, light adjustment of wide range in practical mass production.

SUMMARY OF THE INVENTION

Based on the above, the object of the present invention is to provide a low visual noise beam density light adjusting control circuit used in having a plurality of LEDs as the light source. More specifically, the light source includes the LEDs with different colors. Through controlling the brightness of each LED, the phase of pulse signal is controlled, thus the visual noise interference generated by beam density light adjustment is reduced.

The present invention provides an LED controlling circuit with low visual noise beam density, which is suitable for controlling the brightness of plural groups of LEDs used as the light source in an LCD or other displays. The LED controlling circuit in the present invention includes a control pulse generator and a plurality of LED DC current supplies. Wherein, the control pulse generator is used to receive a brightness adjusting signal and generate a plurality of groups of brightness controlling pulse signals with the same frequency but different phases according to the brightness adjusting signal. And the working cycle of the brightness control pulse signals varies within a predetermined range according to the brightness adjusting signal. In addition, the LED DC current supplies are coupled to the control pulse generator to drive the corresponding LED according to the brightness control pulse signals.

In an embodiment, the brightness control pulse signal generator of the LED control circuit includes a triangular-wave generator and a comparator unit, wherein the triangular-wave generator can generate a plurality of groups of the triangular waves with the same frequency but different phases. Each comparators in the comparator unit can compare the triangular waves with the same frequency but different phases to the previously described brightness control pulse signal with the same frequency, the same working cycle but different phases.

From another point of view, the present invention provides a light source apparatus which is suitable to be used in LCDs. The light source apparatus in the present invention includes a brightness control pulse generator, a plurality of LED DC current supplies and a plurality of LEDs. Wherein, the brightness control pulse generator is used to receive a brightness adjusting signal and generate a plurality of groups of the brightness control pulse signals with the same frequency, the same working cycle but different phases according to the brightness adjusting signal. And the LED DC current supplies are coupled to the brightness control pulse generator to drive the corresponding LED according the brightness control pulse signal.

In the embodiment, the brightness control pulse generator of the low visual noise beam density light adjustment control circuit is implemented using a digital microprocessor and/or other digital circuit.

In the embodiment of the present invention, the working cycle of the above brightness control pulse signal varies within a predetermined range according to the brightness adjusting signal.

It can be seen from the above description, using an LED control circuit of low visual noise beam density of the present invention, the visual noise interference generated by the beam density light adjustment can be reduced through the phase of interleaved plural groups of brightness control pulse signals.

The accompanying drawings are included to provide a further understanding of the invention, and are incorporated in and constitute a part of this specification. The drawings illustrate embodiments of the invention and, together with the description, serve to explain the principles of the invention

DESCRIPTION OF EMBODIMENTS

Figure 1:
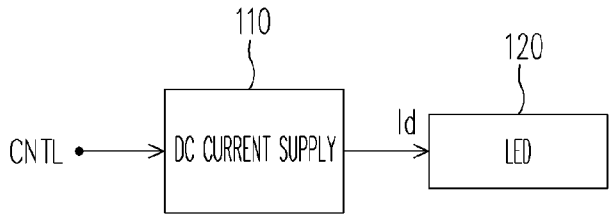
FIG. 1 (PRIOR ART)
FIG. 1 is a schematic diagram of a conventional beam density light adjustment control circuit.
Figure 2:
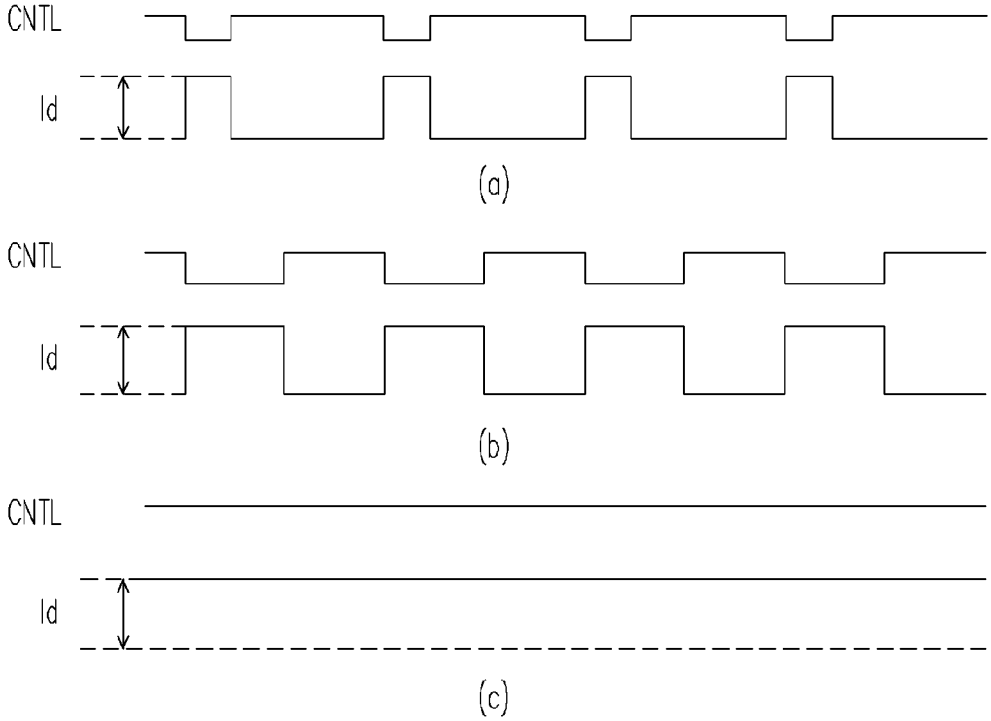
FIG. 2 (PRIOR ART)
FIG. 2 is a schematic diagram of the relation between the brightness control pulse signal and the LED driving current signal of the circuit in FIG. 1.
Figure 3:
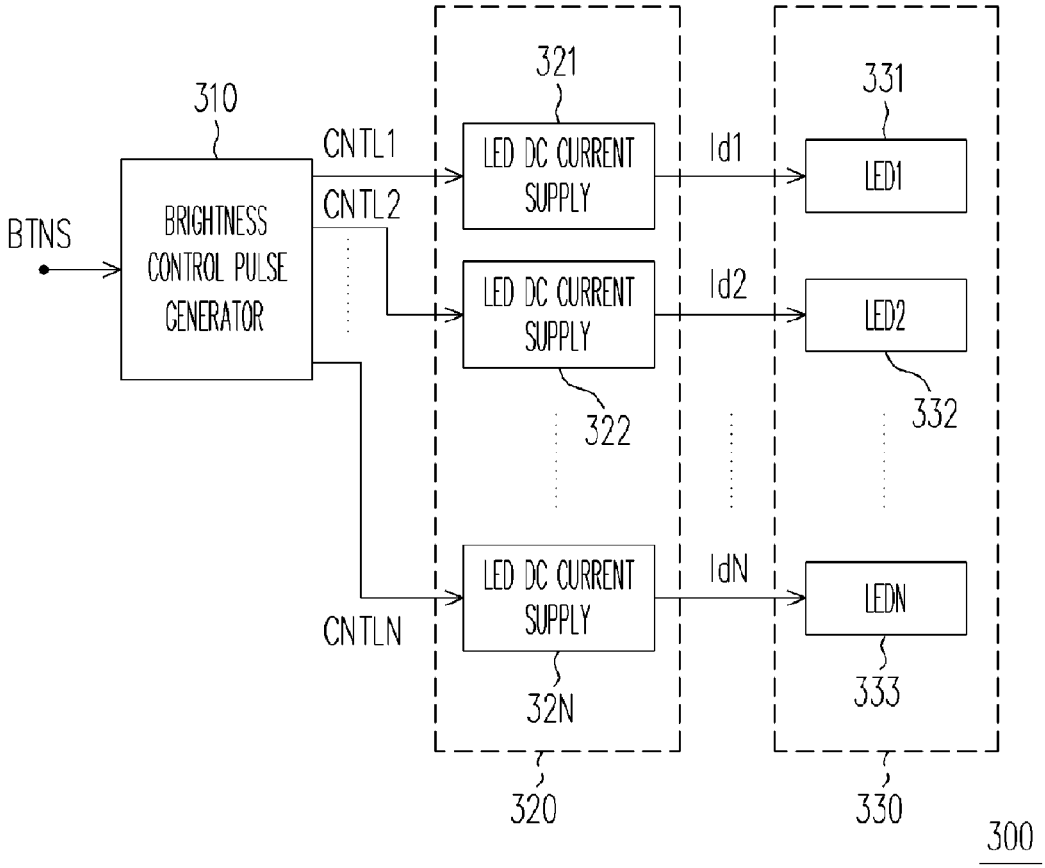
FIG. 3 is a schematic block diagram of a low visual noise beam density light adjustment control circuit according to the embodiment of the present invention.

With reference to FIG. 3, FIG. 3 is a schematic block diagram of a low visual noise beam density light adjusting control circuit according to the embodiment of the present invention. The low visual noise beam density light adjusting control circuit 300 is suitable for controlling the brightness of plural groups of LEDs 330 in an LCD.

As shown in FIG. 3, the low visual noise beam density light adjusting control circuit 300 includes a brightness control pulse generator 310, an LED DC current supply unit 320 and LEDs 330. Wherein, the brightness control pulse generator 310 is used to receive the brightness adjusting signal BTNS and generate plural groups of brightness control pulse signals within a predetermined range according to the brightness adjusting signal BTNS. And wherein there could be least two of the phases of the control pulse signals CNTL1, CNTL2, . . . , CNTLN are different, or the phases of the control pulse signals CNTL1, CNTL2, . . . , CNTLN could be all different from each other.

Wherein, each of the DC current supplies, 321, 322, . . . 32N in the LED DC current supply unit 320 supplies different groups of LEDs, 331, 332, . . . 33N with different groups of currents Id1, Id2, . . . IdN respectively. When these LEDs 331, 332 . . . 33N colors are the same, a predetermined value of the same current value can be set according to the brightness needed. When the colors of the LEDs 331, 332, . . . 33N are different, for example, are red, blue and green, the current values which are different from each other can also be set according to the brightness and the color of the mixed light, for example, white color.

These brightness control pulse signals CNTL1, CNTL2, . . . , CNTLN which are generated according to the brightness control pulse generator 310 will respectively control each of the DC current supplies 321, 322, . . . 32N in the LED DC current supply unit 320 correspondingly to determine the conduction or cut-off status of the conductive current Id1, Id2, . . . , IdN of each group of LEDs 331, 332, . . . , 33N.

In the present invention, in order to reduce the visual noise interference generated by the beam density light adjustment, the phases of these plural groups of brightness control pulse signals CNTL1, CNTL2, . . . , CNTLN are controlled in an interleaving manner, so that at any time point only one of the different groups, LEDs 321, 322, . . . 32N, is cut-off or conducted due to light adjustment is reduced.

Since the LEDs do not change their cut-off or conducting status together because of the synchronous light adjustment, the power supply noise generated due to the change of the conduction of LEDs can be greatly reduced. When LEDs serve as the LCD light source, the beat interference generated from these power supply noises and the vertical and horizontal scanning signals in video signals are the so called "fan effect", so that results in the interference on the video images.

Figure 4:
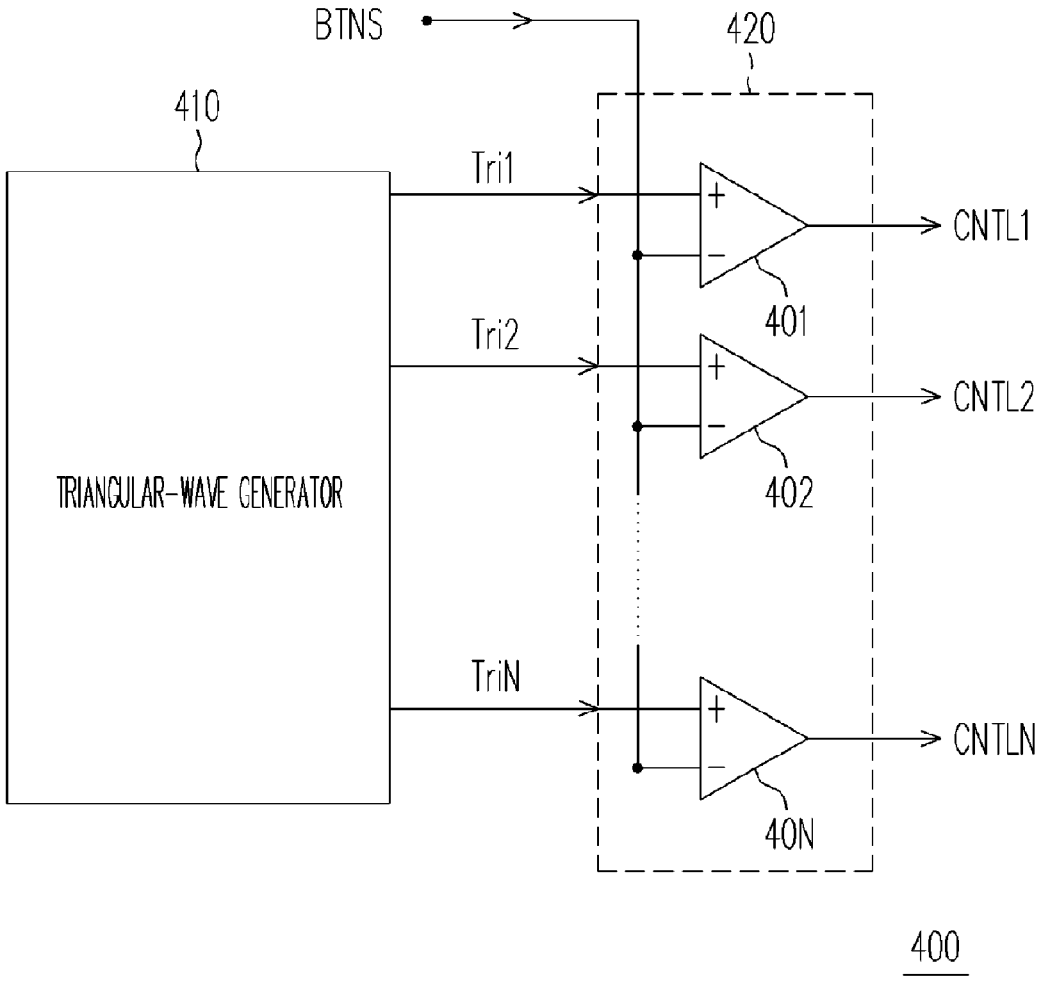
FIG. 4 is a schematic diagram of the circuit of a brightness control pulse generator according to the embodiment of the present invention.

With reference to FIG. 4, FIG. 4 is a schematic diagram of the circuit of a brightness control pulse generator according to the embodiment of the present invention. The brightness control pulse generator 400 includes a triangular-wave generator 410 and a comparator unit 420. Wherein, the triangular-wave generator 410 generates a plurality of triangular-waves Tri1, Tri2, . . . TriN with the same frequency but different phases. And the comparators 401, 402, . . . 40N in the comparator unit 420 compare the brightness adjusting signals BTNS and these triangular-waves Tri1, Tri2, . . . TriN with the same frequency but different phases to generate the brightness control pulse signals CNTL1, CNTL2 . . . CNTLN with the same frequency and working cycle but different phases as described earlier.

Figure 5A:
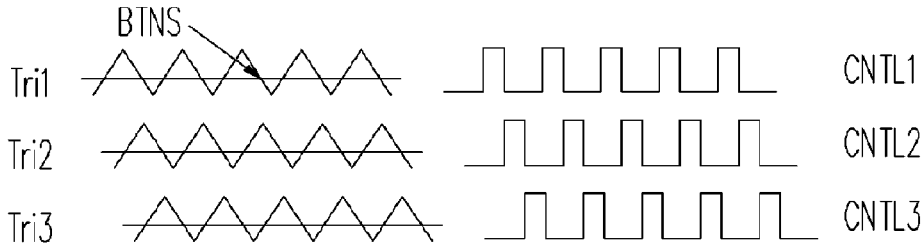
FIG. 5A and FIG. 5B schematically illustrate the brightness control pulse signal generated by the brightness control pulse generator in FIG. 4.
Figure 5B:
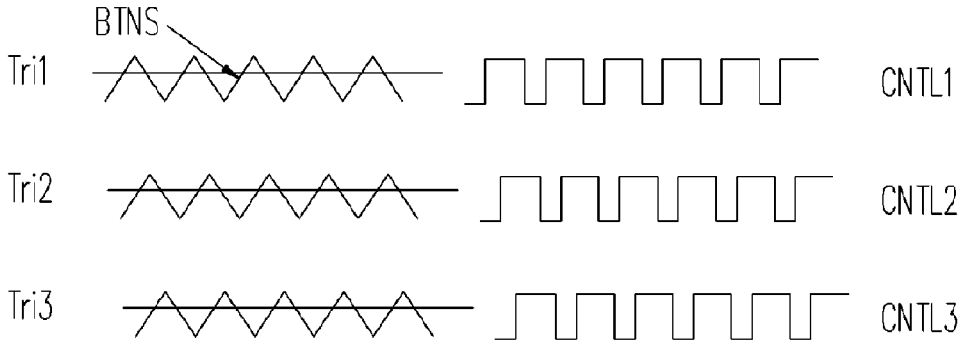

To describe the spirit of the present invention more clearly, when the present embodiment controls three groups of LEDs, the sequence relation diagram of the control signals is shown in FIG. 5A and FIG. 5B. Wherein, FIG. 5A schematically illustrates the time sequence diagram which when the controlled brightness is ⅔, i.e. 66.67% of the LED full brightness. And FIG. 5B schematically illustrates the time sequence diagram which when the controlled brightness is ⅓, i.e. 33.33% of the LED full brightness.

When the phase difference of the three groups of triangular-wave signals Tri1, Tri2 and Tri3 in the present embodiment is 60°, the brightness control pulse signals CNTL1, CNTL2 and CNTL3 of different phases can also be generated after comparing with the brightness adjusting signal BTNS. To control LEDs with such signals enables the three groups of LEDs to change the conducting or cut-off status non-simultaneously, so that on the entire power supply online there is always only one group of LEDs changing the conducting or cut-off status at any time. Comparing with the control method that the three groups of LEDs change the conducting or cut-off status simultaneously, the present invention can reduce the power supply online ripples by ⅓.

Although the above description only provides the control method of three groups of LEDs, it will be understood by those of ordinary skill in the art that more groups of LEDs control circuit may be implemented as needed therein without departing from the spirit and scope of the present invention.

Figure 6:
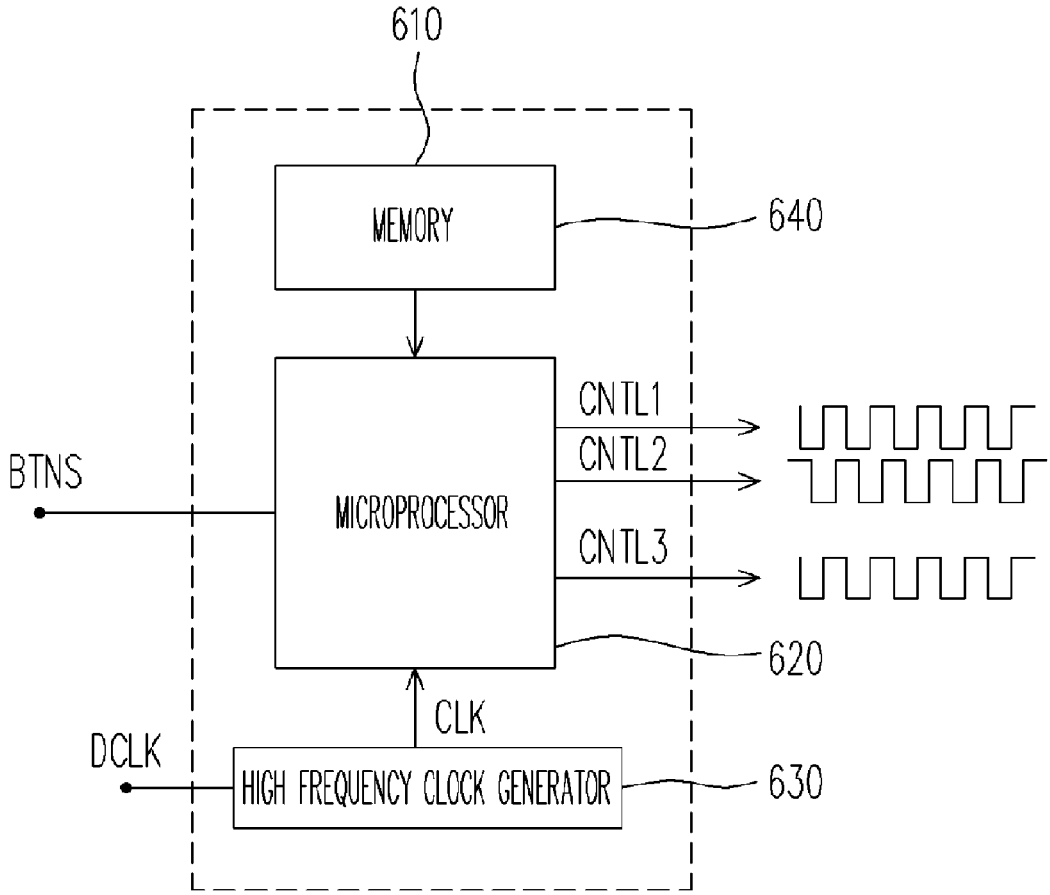
FIG. 6 schematically illustrates an implementation of the circuit diagram of a digital brightness control pulse generator according to the embodiment of the present invention.

When the number of groups increases, using a digital circuit to implement the present invention can control more groups of LEDs more accurately. FIG. 6 schematically illustrates an embodiment implementing digital microprocessor and other digital circuit.

In the embodiment of FIG. 6, digital brightness control pulse generator 610 includes a microprocessor 620, a high frequency clock generator 630 and a memory 640 used to store all the design parameters and programs. The high frequency clock generator 630 provides the operating clock CLK needed by the microprocessor 620, and the microprocessor uses the high frequency clock in conjunction with its internal divider and counter (not shown) to generate the brightness pulse signals CNTL1, CNTL2 . . . CNTLN with predetermined frequency and working cycle based on the input brightness adjusting signal BTNS. And all the design parameters and programs stored in the memory 640 are used to determine the working frequency of the these plural groups of brightness pulse signals CNTL1, CNTL2 . . . CNTLN generated by the microprocessor 620 calculation, and the phase relations between the brightness pulse signals.

Since the working cycle of the brightness pulse signals CNTL1, CNTL2 . . . CNTLN is based on the input brightness adjusting signal BTNS and the digital counter is used to count the clock CLK generated by the high clock generator 630, there is almost no offset among each group of the brightness pulse signals CNTL1, CNTL2 . . . CNTLN. Referring the embodiment of FIG. 4, since the offsets of the comparators 401, 402 . . . 40N are different, and the voltages of these offsets have their individual temperature parameters, therefore the digital signal generating method in FIG. 6 has excellent operation stability comparing with the embodiment of FIG. 4. Thus, it is very suitable for more groups of complicated control circuits which require accurate light adjustment, especially in the case that the white light of LEDs is created by mixing the LEDs of different colors. Because in such system, once the ratio of the lighting working cycle of LEDs of different colors changes, for example, the operation cycle of CNTL1≠the operation cycle of CNTL2≠ . . . ≠the operation cycle of CNTLN, the result of light mixing may change, and the color thereof may change accordingly. Therefore, the LEDs can create any color as needed. And the memory of the embodiment of FIG. 6 can store the contents that determine the various different colors and brightness according to the requirements to create each group of brightness pulse signals CNTL1, CNTL2 . . . CNTLN.

In the embodiment of FIG. 6, in order to further reduce the visual noise generated when using the system as the LCD light source, the clock signal DCLK generated by LCD can also be used as the input signal of the high frequency clock generator 630 to generate high frequency clock CLK, so as to prevent the ripples caused by beat interference from appearing on the display.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A light adjustable LED control circuit, suitable for controlling a plurality of LEDs, comprising:

a plurality of DC current supplies, coupled to the LEDs for providing a DC current to the corresponding LED respectively;

a memory, used to store a plurality of parameters and programs;

a high frequency clock generator, used to provide an operating clock; and a microprocessor, coupled to the DC current supplies, the memory and the high frequency clock generator for generating a plurality of control pulse signals with fixed and same frequency to corresponding DC current supply respectively according to the operating clock, the parameters and the programs, wherein the working cycle of these control pulse signals changing within a predetermined range but with different phases according to a brightness adjusting signal to control the current supplying status of these DC current supplies respectively.

2. The light adjustable LED control circuit of claim 1, wherein these LEDs comprise at least two LEDs of different colors.

3. The light adjustable LED control circuit of claim 2, wherein these LEDs of different colors are driven by the DC currents of different current values.

4. The light adjustable LED control circuit of claim 1, wherein the frequency of these control pulse signals is determined according to the clock signal of the display.

5. The light adjustable LED control circuit of claim 1, wherein the phases of the control pulse signals are different from each other.

6. A light source apparatus suitable for an LCD, comprising:

a plurality of LEDs;

a plurality of DC current supplies, coupled to the LEDs respectively for providing a driving current to the corresponding LED respectively;

a memory, used to store a plurality of parameters and programs;

a high frequency clock generator, used to provide an operating clock; and a microprocessor, coupled to the DC current supplies, the memory and the high frequency clock generator for generating a plurality of control pulse signals with fixed and same frequency to corresponding DC current supply respectively according to the operating clock, the parameters and the programs, wherein the working cycle of these control pulse signals changing within a predetermined range but with different phases according to a brightness adjusting signal to control the current supplying status of these DC current supplies respectively.

7. The light source apparatus of claim 6, wherein these LEDs comprise at least two LEDs of different colors.

8. The light source apparatus of claim 7, wherein these LEDs of different colors are driven by the DC currents of different current values.

9. The light source apparatus of claim 6, wherein the frequency of the control pulse signal is determined according to the clock signal of the LCD.

10. The light source apparatus of claim 6, wherein the frequency of these control pulse signals is determined according to the clock signal of the display.

11. The light source apparatus of claim 6, wherein the phases of the control pulse signals are different from each other.

* * * * *